United States Patent [19]

Frankel et al.

[11] 4,122,124

[45] Oct. 24, 1978

[54] PRODUCTION OF TRINITROMETHANE

[75] Inventors: Milton B. Frankel, Tarzana; Frank C. Gunderloy, Jr., Santa Susana; Dean O. Woolery, II, Reseda, all of Calif.

[73] Assignee: Rockwell International Corporation, El Segundo, Calif.

[21] Appl. No.: 857,055

[22] Filed: Dec. 5, 1977

[51] Int. Cl.[2] ..... C07C 76/02

[52] U.S. Cl. ..... 260/644; 149/88

[58] Field of Search ..... 260/644

[56] References Cited

U.S. PATENT DOCUMENTS 3,491,160 1/1970 Welch et al. ..... 260/644

OTHER PUBLICATIONS

Noble, Jr. et al., Chem. Reviews, vol. 64, pp. 19–27 (1964).

*Primary Examiner*—Leland A. Sebastian

*Attorney, Agent, or Firm*—L. Lee Humphries; Robert M. Sperry

[57] ABSTRACT

A method of producing trinitromethane comprising reacting isopropyl alcohol with nitric acid, wherein the reaction is maintained within a temperature range of from about 25° to about 85° C to produce said trinitromethane and recovering the trinitromethane so produced. It is a particular advantage of the present method that no catalyst is required.

6 Claims, No Drawings

PRODUCTION OF TRINITROMETHANE

The invention herein described was made in the course of or under a contract or subcontract thereunder, (or grant) with the Air Force.

BACKGROUND OF THE INVENTION

1. Field of the Invention

The present invention concerns a method for production of trinitro compounds. Specifically, the present invention relates to a method for the production of trinitromethane (nitroform) by the reaction of nitric acid with isopropyl alcohol.

2. Description of the Prior Art

It was known heretofore (Orton and McKie, JCS, 1920) that nitroform could be produced by introducing acetylene gas into concentrated nitric acid under catalysis with mercury salts. In this manner a solution is obtained which contains approximately 70–90% nitric acid, 5–11% nitroform, the remaining solution comprising water, small amounts of oxalic acid, etc.

Nitroform (trinitromethane) is a very valuable compound for use in the preparation of explosive and propellant ingredients, due to its high oxygen content and labile hydrogen atom, which facilitates the preparation of trinitromethyl and fluorodinitromethyl derivatives. Of particular interest, is the use of nitroform for the preparation of bis(fluorodinitroethyl) formal (FEFO) and 1,3-bis(fluorodinitroethoxyl)-2,2-bis(difluoroamino) propane (SYEP). Both FEFO and SYEP are energetic plasticizers that are being utilized in advanced solid propellants. Consequently, low-cost processes for their production are required. This, of course, necessitates starting their production with low-cost nitroform.

An industrial scale facility for the production of trinitromethane based on the reaction between acetylene and nitric acid was reported by A. Wetterholm, *Tetrahedron,* 1963, Vol. 19, pp. 155–163. The industrial plant which utilized a mercury catalyst comprised three basic elements, namely, a nitrator for the oxidation nitration reaction, a distillation system consisting of one or more fractionating towers and an evaporator, and equipment for concentrating the dilute nitric acid, which was formed during the reaction. A maximum yield of approximately 75% was obtained. A disadvantage of this process is the requirement for the mercury catalyst. Specifically, for the process to be economical, the nitric acid must be recovered for reuse in the process, and the separation of the nitric acid from the mercury catalyst is difficult. In addition, the use of a mercury catalyst substantially adds to the cost of the process. Obviously, therefore, it would be desirable to have a process for the production of trinitromethane which did not involve the use of an expensive catalyst, and which would be safe and economical.

SUMMARY OF THE INVENTION

In accordance with the present invention, there is provided a safe, economical method of producing trinitromethane. Broadly, the method comprises reacting isopropyl alcohol with nitric acid (preferably concentrated). The reaction is maintained within a temperature range of from 25° to 85° C. for a time sufficient to produce the trinitromethane. It is a particular advantage of the present invention that no catalyst is required. Thus, any excess of unreacted nitric acid is readily recoverable for reuse in the process.

DESCRIPTION OF THE PREFERRED EMBODIMENTS

The method of the present invention is applicable to both batch and continuous methods for producing trinitromethane. The desired trinitromethane is produced by introducing isopropyl alcohol into contact with nitric acid in a reaction zone.

It will be obvious to those skilled in the art that other similar alcohols also would be useful in the present method; however, isopropyl is preferred in view of its cost, availability, and safety. More particularly, the cost of isopropyl alcohol is only about one-fourth that of acetylene. Further, even when the yields are compared (based on obtaining 100% of the theoretical yield) to obtain a relative cost the isopropyl alcohol is cheaper by a factor of about 2 to 1. Another advantage of using isopropyl alcohol over acetylene is safety. Acetylene is flammable in air in concentrations from as low as 2.5 volume percent to as high as 81 volume percent. Indeed, acetylene is flammable over a significantly wider range of concentrations than hydrogen. Isopropyl alcohol is flammable in air only in concentrations of from about 2 to 12%; thus, the safety advantage is obvious.

The isopropyl alcohol and nitric acid need not be pure. Specifically, commercial grades of nitric acid and isopropyl alcohol are satisfactory for use in the process of the present invention. To obtain significant yields of the desired trinitromethane it is essential that the isopropyl alcohol be introduced into an excess of nitric acid. Thus, the molar ratio of nitric acid to isopropyl alcohol will be in excess of about 8:1. Too great an excess of nitric acid will, of course, increase the cost of the method, and will require an unnecessary amount of nitric acid to be distilled and recycled to the process. Thus, the molar ratio of nitric acid to isopropyl alcohol generally is maintained within a range of from about 10 to 25, and preferably within a range of from about 15:1 to 20:1.

The reaction temperature is not particularly critical, provided, of course, that the temperature must be sufficiently high to maintain the mixture of reactants in a liquid phase. In addition, the temperature should not be too high, otherwise substantial gas evolution takes place with little or no formation of nitroform. Therefore, the temperature generally has been maintained within a range of from about 25° to 85° C. and preferably within a range of from about 40° to 70° C. The time required for the reaction will vary with temperature, pressure ratio of reactants, etc. Generally, a time of from about 1 to 5 hours is sufficient to react substantially all of the isopropyl alcohol to form the desired trinitromethane.

Pressure has not been found to be a particularly critical parameter in accordance with the present method. However, it will be obvious to those versed in the art that higher pressures would tend to keep the gaseous products in solution, which would be undesirable, and extremely low pressures would result in vaporization of the isopropyl alcohol, making it difficult to maintain in solution. Accordingly, the method of the present invention advantageously is practiced at about ambient pressure, i.e., from about 0.5 to about 2 atmospheres.

The isopropyl alcohol is introduced slowly into contact with the nitric acid to form gaseous and liquid reaction products, the gaseous products consisting essentially of oxides of carbon and nitrogen, for example, CO, $CO_2$, NO, $NO_2$, etc. The liquid reaction products comprise nitric acid, trinitromethane, and a minor amount of water. In addition, the liquid phase reaction products also may include a total of 1% or less of oxalic acid and minor amounts of partially oxidized isopropyl alcohol products.

The nitroform subsequently is recovered utilizing known procedures such as the methods disclosed in U.S. Pat. Nos. 3,880,941 and 2,658,084, the disclosures of which are incorporated herein by reference. Broadly, the method comprises adding a sufficient amount of water to the liquid reaction product, such that the content of nitric acid is lower than that corresponding to the content of nitric acid in an azeotropic mixture of nitric acid, water and trinitromethane, such that upon distillation a mixture comprising less than about 35% nitroform (the balance being water) is obtained, which is essentially free of any nitric acid.

The following examples are set forth to further illustrate the method of the present invention.

EXAMPLE I

A 250 ml three-necked flask was fitted with a mechanical stirrer, a thermometer and a dropping funnel. 140 ml (3.33 moles) of 98% nitric acid was introduced into the flask. The acid was warmed to about 60° C. and 20 ml (0.26 mole) of isopropyl alcohol was added dropwise over a 10-minute interval. External cooling was used to maintain the temperature at 60° C. The solution was then heated to a temperature of about 70° C. and held at this temperature for 2 hours. Substantial quantities of brown gaseous fumes evolved during this nitration. The solution subsequently was cooled to ambient temperature and analyzed for nitroform content. The yield of nitroform was determined to be 9.8 gm (approximately a 25% yield).

It will be appreciated that this was an initial test and does not represent the optimum operating conditions. Indeed, the precise conditions for an optimum yield will depend, of course, upon the temperature selected, pressure, the rate of introduction of the reactant, and the concentration or strength of acid used. Thus, while a commercial 70% nitric acid solution would be suitable, the reaction rate and yield would be relatively low. Conversely, a 100% solution of nitric acid would be preferable from the standpoint of optimizing yield and reaction time. However, in the interest of economy, a commercial 98% nitric acid is preferred.

EXAMPLE II

The following example is set forth to demonstrate the method of the present invention as applied to a continuous process for the production of trinitromethane. The reactor utilized is substantially the same as that which would be used for the production of trinitromethane by reacting nitric acid and acetylene in the presence of a mercuric nitrate catalyst. Specifically, the reactants are fed in at the bottom of a vertical tube. The reaction produces sufficient gas, so that a gas lift is obtained. The reactants then pass through a horizontal gas-liquid disengaging section of tube, and then through a return leg back to the reactant introduction tube. As the liquid level builds up in the return tube, part of it is taken off as product. Four separate runs were made. The test conditions and yields are set forth in Table I below.

TABLE I

| Run | Molar Ratio $HNO_3$/IPA | Time (Min.) After Start | Temp. °C | Nitroform lb/hr | Yield moles NF/moles IPA |
|---|---|---|---|---|---|
| 1A | 24.9 | 134 | 79 | 1.8 | 15.9 |
| 1B | 24.9 | 204 | 76 | 2.2 | 19.5 |
| 1C | 24.9 | 264 | 76 | 2.4 | 21.2 |
| 2A | 22.5 | 160 | 64 | 4.7 | 37.5 |
| 2B | 22.5 | 220 | 66 | 5.3 | 42.3 |
| 2C | 22.5 | 265 | 64 | 6.2 | 49.5 |
| 3A | 18.6 | 241 | 66 | 5.4 | 43.1 |
| 3B | 18.6 | 296 | 66 | 5.3 | 42.3 |
| 3C | 18.6 | 338 | 66 | 7.3 | 58.2 |
| 4A | 16.6 | 135 | 68 | 4.4 | 35.1 |
| 4B | 16.6 | 213 | 65 | 5.6 | 44.7 |
| 4C | 16.6 | 270 | 66 | 4.9 | 39.2 |
| 4D | 16.6 | 340 | 66 | 4.9 | 39.2 |

From the foregoing table it is seen that yields in the 50–58% range were obtained. It is believed that with further optimization, yields of 60 to 70% or greater are readily obtainable with the method of the present invention. Further, even with the yields obtained, the method of the present invention is economically preferable over the prior art method, and it is accomplished without the need of any catalyst.

While the present invention has been described with respect to what at present are considered to be preferred embodiments thereof, it will be understood that changes, substitutions, modifications, and the like, may be made therein without departing from the scope of the invention. Specifically, in certain circumstances it may be desirable to add a catalyst to increase the rate of reaction. Alternatively, it may be desired to operate under less than optimum conditions in the interest of economics, accepting any decrease in yield obtained. It also will be appreciated that present invention is also applicable to the production of tetranitromethane simply by the addition of sulfuric acid to the nitric acid-isopropyl alcohol mixture. Therefore, the foregoing examples and description are for the purpose of illustration only, and shall not be considered as limiting the scope of the instant invention, reference being had to the appended claims for such latter purpose.

What is claimed is:

1. A method of producing trinitromethane comprising reacting isopropyl alcohol with nitric acid, said reaction being maintained with a temperature range of from about 25° to 85° C. to produce trinitromethane and recovering the trinitromethane so produced.

2. The method of claim 1 wherein the molar ratio of nitric acid to isopropyl alcohol is within the range of from about 10:1 to 25:1.

3. The method of claim 2 wherein the reaction is maintained at a temperature within the range of from about 40° to 70° C.

4. The method of claim 3 wherein said nitric acid is 98% pure.

5. A method of producing trinitromethane comprising:

continuously introducing a mixture of isopropyl alcohol and 98% nitric acid into a reaction zone, said nitric acid and isopropyl alcohol being introduced in a molar ratio of nitric acid to isopropyl alcohol of from about 10:1 to 25:1, and maintaining said mixture at a temperature of from about 40° to 70° C. to produce said trinitromethane and recovering the trinitromethane so produced.

6. The method of claim 1 wherein said mixture is maintained at said temperature for a time of from about 1 to 4 hours.

* * * * *